United States Patent [19]

Müller

[11] Patent Number: 4,880,402

[45] Date of Patent: Nov. 14, 1989

[54] METHOD AND APPARATUS FOR PREVENTING THE ATTACHMENT OF FOREIGN BODIES TO CONTROLLABLE PITCH PROPELLER LINKAGES OF WATERCRAFT

[76] Inventor: Peter Müller, Widmerstrasse 27, Zürich, Switzerland

[21] Appl. No.: 86,921

[22] Filed: Aug. 18, 1987

[30] Foreign Application Priority Data

Aug. 22, 1986 [CH] Switzerland ..... 3374/86

[51] Int. Cl.[4] ..... B63H 3/08

[52] U.S. Cl. ..... 440/50; 416/162; 416/167

[58] Field of Search ..... 440/50; 416/159, 162, 416/164, 166, 167

[56] References Cited

U.S. PATENT DOCUMENTS

| | | | |
|---|---|---|---|
| 718,881 | 1/1903 | Sarr | 440/50 |
| 2,138,574 | 11/1938 | Gallagher | 440/50 |
| 2,374,833 | 5/1945 | Rippingille | 416/166 |
| 3,095,932 | 7/1963 | Hercules | 416/166 |
| 4,599,043 | 7/1986 | Muller | 416/164 X |

*Primary Examiner*—Sherman D. Basinger
*Attorney, Agent, or Firm*—Helfgott & Karas

[57] ABSTRACT

A watercraft has a rotatable propeller drive shaft connected to a driving engine. A coupling is slidably disposed along the shaft. The coupling has a rotatable first section secured to the shaft and a non-rotatable second section spaced from the shaft with a bearing arrangement in which the first section is rotatably disposed. A variable pitch propeller has a hub secured to the shaft. A plurality of propeller blades are rotatably disposed in bearing housings to the hub. Connecting rods are slidably disposed in the bearing housings. Each connecting rod has a position of protection at which it is disposed completely in the corresponding bearing housing wherein it cannot be attacked by foreign bodies. Devices for coupling one end of each rod to the base of the corresponding blade are provided. Each connecting rod at its other end has a tie rod which partially extends out of the bearing housing in the operative position of the engine but is concealed within the bearing housing in the inoperative position of the engine. The movement of the second section of the coupling back and forth along the shaft appropriately adjusts the pitch of the blades.

5 Claims, 3 Drawing Sheets

METHOD AND APPARATUS FOR PREVENTING THE ATTACHMENT OF FOREIGN BODIES TO CONTROLLABLE PITCH PROPELLER LINKAGES OF WATERCRAFT

BACKGROUND OF THE INVENTION

The present invention relates to a method and apparatus for the prevention of the attachment of foreign bodies to parts of a connecting rod linkage for the adjustment of the blades of a controllable pitch propeller in a motor-driven watercraft. In watercraft, connecting rods of a connecting rod linkage are adjustable by means of an adjusting linkage via a rotary-slide coupling interconnecting the rotary and displaceable, non-rotary part of the connecting rod linkage.

Controllable pitch propellers for watercraft of varying construction are known in the prior art. When controllable pitch propellers are used in large watercraft, that is for high power ship propulsion systems, adjusting linkages of individual propeller blades are housed in a variable pitch propeller hub. The adjusting linkages are operated by means of a connecting rod which is located in the center of a hollow drive shaft which carries at its end and adjusting flange, on which are supported the adjusting linkages. Reference should be made in this connection to an article in "*Internat. Shipbuilding Progress*", February/March 71 by J. Wind, "Principles of Mechanisms Used in Controllable Pitch Propellers", particularly FIG. 8. The connecting rod is operated by a hydraulic linear motor comprising cylinders and pistons and is either incorporated into the drive shaft or is connected via an adjusting linkage to the connecting rod, cf., U.S. Pat. No. 3,095,932.

When a correspondingly smaller propulsive output controllable pitch propellers are used in smaller watercraft, adjustment of the propeller blades takes place by means of a mechanical lever bar via a hydraulic linear motor as described in U.S. Pat. No. 4,599,043 or via manual actuation as described in U.S. Pat. No. 2,742,097.

A significant problem which develops in the use of controllable pitch propellers for watercraft is that foreign bodies and in particular barnacles are deposited on the moving parts of the adjusting linkage and these bodies impede or block the adjusting movements of the propeller. This more particularly applies in the case of the connecting rods (the connecting rod linkage) for adjusting the propeller blades wherein as a function of the adjustment position of the blades, parts can temporarily come into contact with the water, see for example, U.S. Pat. No. 4,599,043. FIG. 1 of this patent discloses an adjustable drive for the blades of a controllable pitch propeller whose connecting rods are connected at their free ends to a rotary-slide coupling forming the connection between the rotary and the displaceable, non-rotary part of the connecting rod linkage. The rotary-slide coupling is surrounded by water as are the free ends of the connecting rods located in the rotary propeller hub. It is known to protect by bellows seals or joints, movable parts which have to be protected against environmental influences. However, these arrangements require additional space for installation and are relatively sensitive to damage. Similar conditions also exist with regard to the trimming cylinders of sports boats. Foreign bodies attached to the piston rods can be cleaned by steel stripping rings. However, it is a disadvantage in that this increases the thrust force requirement, without achieving complete cleaning.

SUMMARY OF THE INVENTION

It is an object of the present invention to develop a simple method for preventing the attachment of the aforementioned foreign bodies to the connecting rod linkage for controllable pitch propellers, whereby without using any additional space, parts of the connecting rod linkage which are in water can be protected.

Another object of the invention is to provide a solution wherein immediately after switching off the motor or engine, the connecting rods are brought into a protected position so that the rods are no longer exposed to attack by foreign bodies. On starting the motor or engine, the connecting rods are moved into a position corresponding to the neutral position of the propeller blades. As a result, the desired protective action is achieved without special protective measures since the parts of the adjustable linkage normally in the water are instead located in the hub or bearing housing. By preventing access to such parts it is not necessary to provide separate packing or seals.

Appropriately the protective position during the non-operation of the watercraft and the neutral position in starting the watercraft engine can be obtained manually or automatically.

In accordance with the invention, an apparatus for use in a watercraft having a rotatable propeller drive shaft connected to a driving engine comprises a coupling slidably disposed along the shaft and including a rotatable first section secured to the shaft and a nonrotatable second section spaced from the shaft and having bearing means in which the first section is rotatably disposed; a variable pitch propeller having a hub secured to the shaft, a plurality of bearing housings secured to the hub, and a like plurality of propeller blades each blade having a base, each base being rotatably disposed in the corresponding bearing housing; a like plurality of connecting rods, each connecting rod having two opposite ends and being slidably disposed in the corresponding bearing housing, each connecting rod having a position of protection at which it is disposed completely in the corresponding bearing housing wherein it cannot be attacked by foreign bodies; a like plurality of first coupling means, each first coupling means being disposed in the corresponding bearing housing to couple one end of the corresponding rod to the base of the corresponding blade; and a like plurality of second coupling means provided on said connecting rods and each coupling another end of the corresponding connecting rod to the first section of the coupling whereby movement of the second section of said coupling back and forth along the shaft appropriately adjusts the pitch of the blades. The second section is adapted to place all connecting rods in the position of protection when the engine is in an inoperative or an operative position and is so positioned, when the engine is started, as to place all connecting rods in a position at which the blades are in neutral position.

A like plurality of connection rods are used. Each connection rod has two opposite ends and is slidably disposed in a corresponding housing. Each connecting rod, when the engine is inoperative, has a position of protection at which it is disposed completely in the corresponding housing wherein it cannot be attacked by foreign bodies.

A like plurality of first means are also used. Each first means is disposed in a corresponding housing to couple one end of the corresponding rod to the base of the corresponding blade.

A like plurality of second means are also used. Each second means couples the other end of the corresponding connecting rod to the first section of the coupling whereby movement of the second section back and forth along the shaft appropriately adjusts the pitch of the blades.

The second section is positioned to place all connecting rods in the position of protection when the engine is inoperative and is so positioned, when the engine is started, as to place all connected rods in a a position at which the blades are in neutral position.

The foregoing as well as additional objects and advantages of the invention will either be explained or will become apparent to those skilled in the art when this specification is read in conjunction with the brief description of the drawings and the detailed description of the preferred embodiments which follow.

DETAILED DESCRIPTION OF THE PREFERRED EMBODIMENTS

Figure 1:
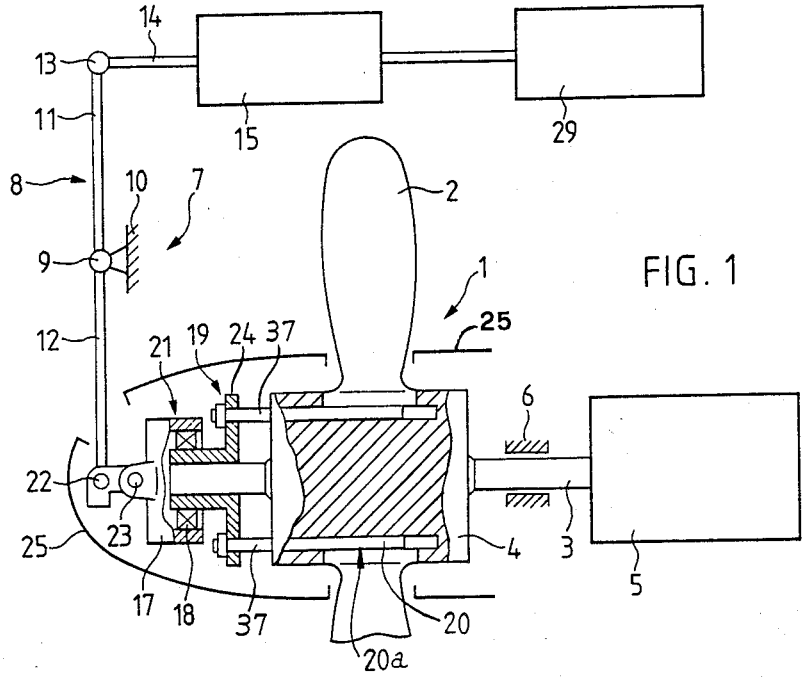
FIG. 1 is a diagram of a controllable pitch propeller for a watercraft with an adjusting apparatus for adjusting the pitch of the propeller blades.
Figure 4:
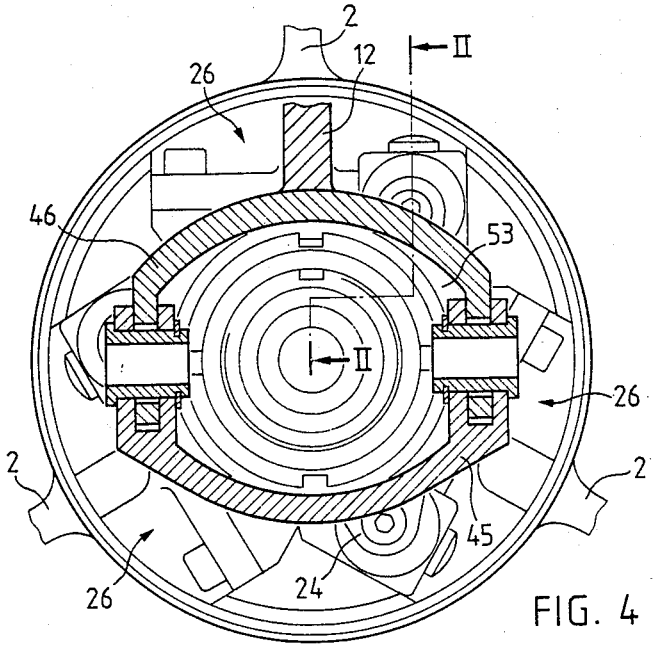
FIG. 4 is a section through the adjustable linkage.
Figure 2:
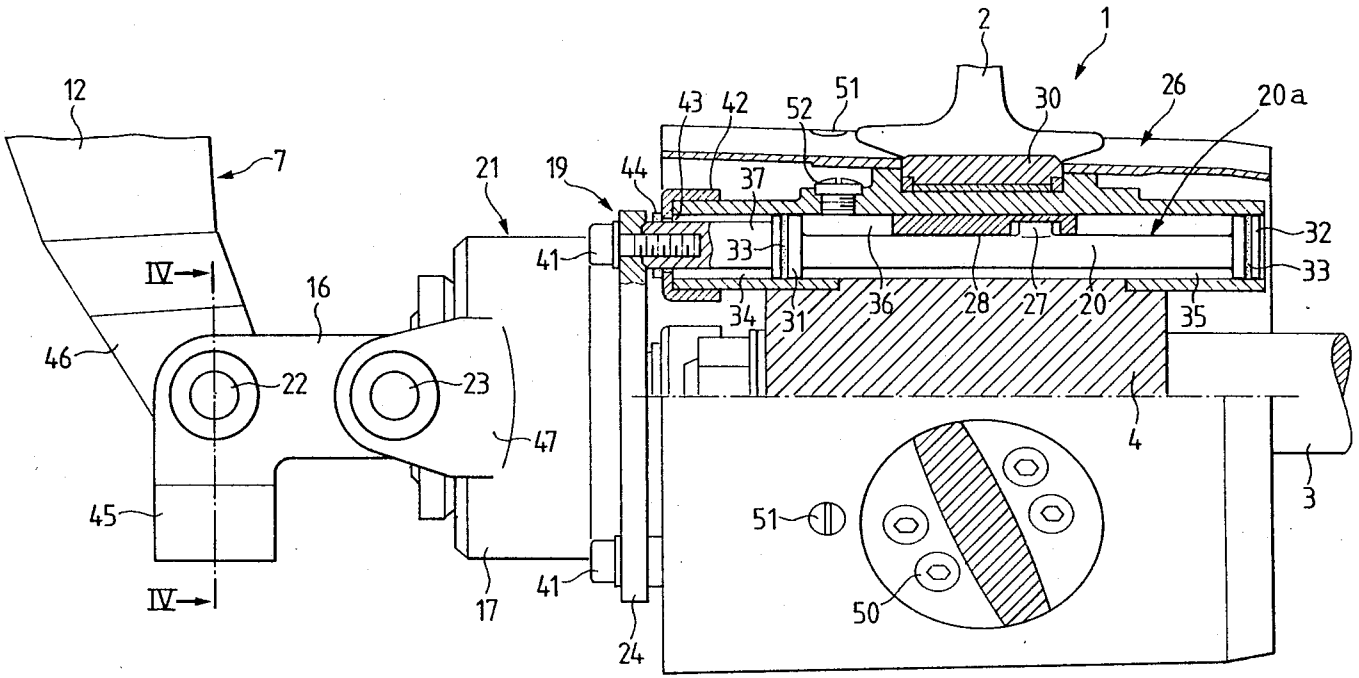
FIG. 2 is a longitudinal section through the hub of a controllable pitch propeller in which the connecting rods of the adjusting apparatus are located in one end position of the connecting rods stroke.
Figure 3:
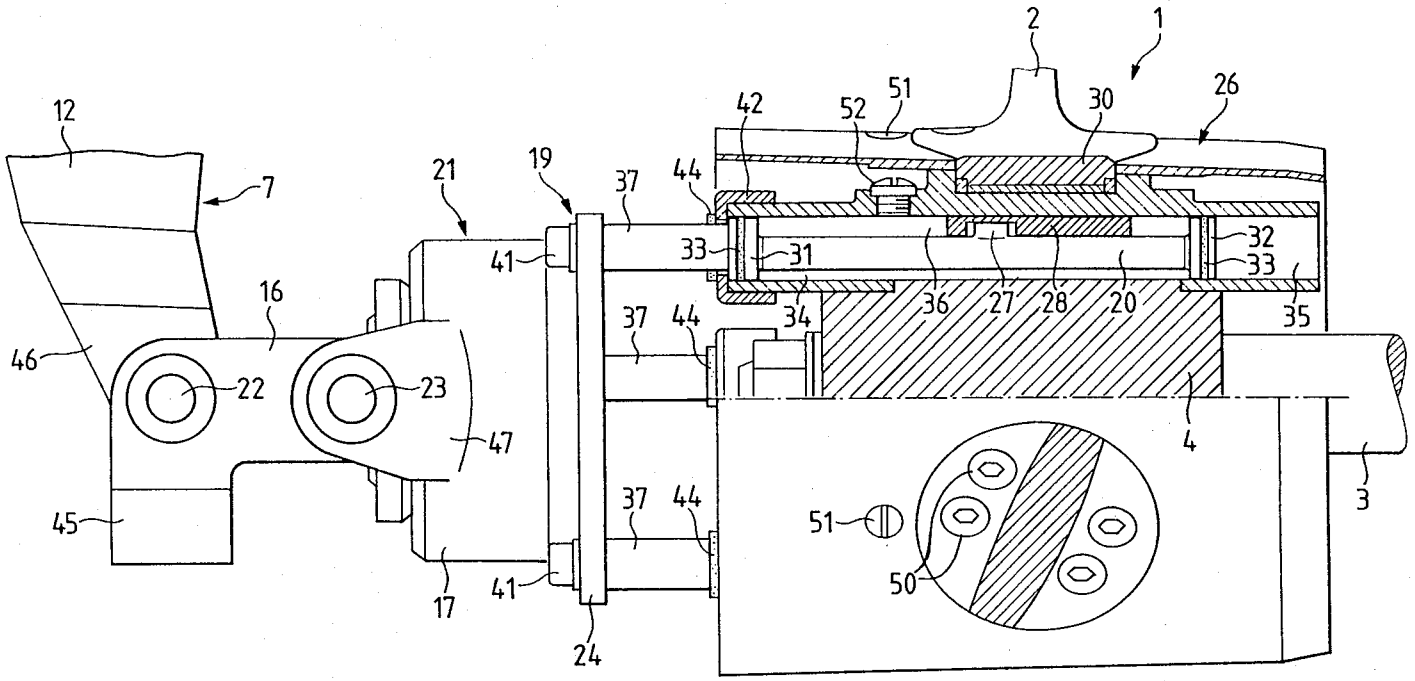
FIG. 3 is a longitudinal section through the hub of a controllable pitch propeller, in which the connecting rods of the adjusting apparatus are located in the end position opposite to that of FIG. 2.

In the diagrammatically represented watercraft drive shown in FIG. 1, a variable or controllable pitch propeller 1 has adjustable propeller blades 2 and a propeller hub 4 driven by a drive shaft 3. Shaft 3 is driven by a driving engine or motor 5 and is mounted in a mounting support 6 in the vicinity of propeller 1. The pitch of the propeller blades 2 is adjustable by a lever bar 7, whose main component is a two-armed lever 8, having a pivot pin 9 pivotably supported in a step bearing 10. Bearing 10 is mounted either on the hull of the watercraft or, if controllable pitch propeller 1 is arranged on the rudder, on part of the rudder. Adjustable lever 8 has upper and lower arms 11, 12, the upper arm 11 being coupled by means of a joint 13 to the push rod 14 of a linear motor 15 driven by a power source 29. The lower arm 12 is connected via joints 22, 23 to a rotary-slide coupling 21. The coupling has a non-rotary coupling 17, connected by means of joints 22, 23 to the lower arm 12. The rotary coupling 19 is fixed to drive shaft 3 and carries the non-rotary coupling 17 by means of radial and axial bearings (only one bearing 18 is diagrammatically shown). The apparatus further comprises; parallel elongated rods 20*a* which include tie rods 37 connected to a flange 24 of rotary coupling 19 and connecting rods 20 rigidly connected to rods 37 and guided in propeller hub 4 to adjust the individual propeller blades 2 upon movement of coupling 21 along shaft 3 of the propeller. Propeller hub 4 and the rotary-slide coupling 21 are surrounded by a hood 25. FIGS. 2 and 3 show that part of the drive according to FIG. 1 in which the inventive solution is shown in detail. Reference numerals have the same meanings as in FIG. 1. In FIGS. 2 and 3 the propeller hub 4 is constructed in multipart with the propeller blades 2 mounted together with the connecting rods 20 in a bearing housing 26 fixed to the propeller hub 4. However, it is also possible to construct the propeller hub 4 and bearing housing 26 in one piece. As shown in FIG. 4, there are three bearing housings 26 corresponding to three propeller blades 2. Connecting rods 20 have adjusting pins 27 which project into adjusting disks 28 with adjusting grooves. Each adjusting disk 28 is connected to the blade base 30 of propeller blade 2 and forms the mounting support for the latter.

Each connecting rod 20 is provided at each of its ends with a piston 31, 32 having a packing 33. Pistons 31, 32 are guided in cylinder bores 34, 35, which issue into an inner area 36 of bearing housing 26. Together with the two cylinder bores 34, 35, inner area 36 forms a constant volume space closed by pistons 31, 32. This space is appropriately filled with a lubricant such as lubricating grease and as a result is not subjected to outside influences.

The tie rod 37 of each rod 20*a* extends from piston 31 and its free end is fixed by means of a screw 41 to the appropriately triangular flange 24 of the rotary coupling of coupling 21. The rotary coupling is covered by the hood-like displaceable, non-rotary coupling 17 of the rotary-slide coupling 21. Between the two parts 17, 19 are arranged not visible radial and axial bearings, via which the adjusting forces are transferred from the adjusting linkage 7 to the connecting rod linkage.

Cylinder bores 34 are covered by a screw cap 42, in whose center is provided a bore 43 with a packing 44 for the passage of tie rod 37.

The adjusting linkage 7 is connected by means of a yoke 46, cf FIG. 4, and a bow-shaped member 45 to a joint 22. Bow-shaped member 45 has cover plate 16, which is connected by means of joints 23 to webs 47 of the displaceable, non-rotary part of the rotary-slide coupling. By means of the passage 53 formed by member 45 and yoke 46, it is also possible to arrange the rotary-slide coupling with adjusting linkage 7 not only on the outlet side, as in FIGS. 2 and 3, but also on the inlet side of the controllable pitch propeller 1.

The connection of the propeller blade 2 to the blade base or adjusting disk 28 takes place by means of screws 50, cf FIGS. 2 and 3. By means of a locking screw 51, access is provided to filler screw or plug 52 which, when removed provides access to closed inner area 36.

Cylinder bore 34 with cap 42 provides protection for tie rod 37 in its position within bearing housing 26, as shown in FIG. 2, without additional means being required. Attacks by foreign bodies cause problems when such attacks take place on tie rod 37. The attached barnacles are very hard and very difficult to remove. However, if tie rod 37 is kept in the dark area, i.e. in present case in cylinder bore 34, there foreign bodies do not attach to it. The same essentially applies with respect to cylinder bore 35, if the connecting rod is in the position shown in FIG. 3. If when the watercraft is stationary tie rods 37 are brought into the position shown in FIG. 2, the cylinder bore 34 is closed by packing 44 and tie rod 37, while cylinder bore 35 is closed by piston 32. If this position of the rods 20*a* with their tie rods 37 is assumed whenever the watercraft is not moving, it is possible to prevent foreign body attachment on tie rods 37 and on to cylinder bores 35. Thus connecting rods 20 are positioned within the bearing housings 26 all the time, in the operative and non-operative position of the engine whereas tie rods 37 extend partially outwardly from the bearing housings 26 in the operative position only.

To ensure that the protected position is assumed, the operation can be accomplished automatically. If the adjusting linkage 7 is operated by a hydraulic linear motor, which is constructed in a differential piston, in which a spring is fitted in the cylinder chamber having the smaller surface, it presses the piston into the position corresponding to that of FIG. 2 when pressure is relieved. On putting the watercraft into operation, the medium pressure forces the piston into a neutral position for idling. The automatic maintainance of the protected position and the neutral position of the connecting rods can also be brought about in other ways, e.g. by relays, which cooperate with limit switches and stop the linear motor in the desired positions.

In connection with the described method and the means required for performing the same, it is clear that the cost is relatively low. However, this simple solution significantly improves the operating reliability of the controllable pitch propeller, in that foreign body attacks are reliably prevented at the critical points of the connecting rod linkage.

While the invention has been described with detailed reference to the drawings, it will be obvious to those skilled in the art that many modifications and changes can be made within the scope and sphere of the invention as defined in the claims which follow.

What is claimed is:

1. Apparatus for use in a watercraft having a rotatable propeller drive shaft connected to a driving engine and comprising:

a coupling slidably disposed along the shaft, the coupling including a rotatable first section secured to the shaft and a non-rotatable second section spaced from the shaft and having bearing means in which the first section is rotatably disposed;

a variable pitch propeller having a hub secured to the shaft, a plurality of bearing housings secured to the hub, and a like plurality of propeller blades, each blade having a base, each base being rotatably disposed in the corresponding bearing housing;

a like plurality of connecting rods, each connecting rod having two opposite ends and being slidably disposed in the corresponding bearing housing, each connecting rod having a position of protection at which it is disposed completely in the corresponding bearing housing wherein it cannot be attacked by foreign bodies;

a like plurality of first coupling means, each first coupling means being disposed in the corresponding bearing housing to couple one end of the corresponding rod to the base of the corresponding blade;

a like plurality of second coupling means provided on said connecting rods and each coupling another end of the corresponding connecting rod to the first section of the coupling whereby movement of the second section of said coupling back and forth along the shaft appropriately adjusts the pitch of the blades, said second section being positioned to place all connecting rods in the position of protection when the engine is in an inoperative or an operative position and being so positioned, when the engine is started, as to place all connecting rods in a position at which the blades are in neutral position.

2. The apparatus of claim 1 wherein each second coupling means includes a tie rod connected to said another end, and wherein a major part of each tie rod is disposed in the corresponding bearing housing when the engine is in the inoperative position.

3. The apparatus of claim 2 wherein at each end of each connecting rod is provided a piston-cylinder guide, and wherein the piston-cylinder guide positioned at the end of the connecting rod facing said coupling is provided with said tie rod, said tie rod of each second coupling means having an end opposite to said connecting rod and connected to a flange of said coupling.

4. The apparatus of claim 3 wherein the piston-cylinder guide positioned at the end of the connecting rod facing said coupling is covered with a cap having a bore, said tie rod extending through the bore of the corresponding cap and being surrounded by packing fixed to the cap.

5. In a method incorporating apparatus for use in a watercraft having a rotatable propeller drive shaft connected to a driving engine wherein a coupling is slidably disposed along the shaft, the coupling having a rotatable first section secured to the shaft and a non-rotatable second section spaced from the shaft with bearing means in which the first section is rotatably disposed, and a variable pitch propeller having a hub secured to the shaft and provided with a plurality of bearing housings secured to the hub, the propeller having a like plurality of propeller blades, each blade having a base, each base being rotatably disposed in the corresponding bearing housing and wherein each of like plurality of connecting rods has two opposite ends and is slidably disposed in the corresponding bearing housing, and wherein each of a like plurality of first coupling means is disposed in the corresponding bearing housing to couple one end of the corresponding rod to the base of the corresponding blade and each of a like plurality of second coupling means couples another end of the corresponding connecting rod to the first section of the coupling whereby movement of the second section back and forth along the shaft appropriately adjusts the pitch of the blades, the method comprising the steps of:

(a) positioning the second section to place all connecting rods in fully concealed position within the corresponding bearing housings to prevent the connecting rods from attack from foreign bodies when the engine is in inoperative or operative position; and (b) when the engine is started, placing all connecting rods in a position at which the blades are in neutral position.

* * * * *